US005851718A

United States Patent [19]

Ohwada et al.

[11] Patent Number: 5,851,718

[45] Date of Patent: Dec. 22, 1998

[54] TONER FOR ELECTROSTATIC IMAGE DEVELOPMENT BY HEAT

[75] Inventors: Takeshi Ohwada; Takashi Shintaku, both of Chigasaki, Japan

[73] Assignee: Mitsubishi Chemical Corporation, Tokyo, Japan

[21] Appl. No.: 912,829

[22] Filed: Aug. 19, 1997

Related U.S. Application Data

[62] Division of Ser. No. 679,337, Jul. 11, 1996, abandoned.

[30] Foreign Application Priority Data

Jul. 14, 1995 [JP] Japan ..... 7-178444
Jul. 14, 1995 [JP] Japan ..... 7-178445

[51] Int. Cl.[6] ..... G03S 15/20

[52] U.S. Cl. ..... 430/124; 430/110; 427/194

[58] Field of Search ..... 430/124, 99, 110; 427/194

[56] References Cited

U.S. PATENT DOCUMENTS 4,407,922 10/1983 Grushkin et al. .

FOREIGN PATENT DOCUMENTS

| | | |
|---|---|---|
| 0 253 524 | 1/1988 | European Pat. Off. . |
| 63-23961 | 2/1988 | Japan . |
| 92/01245 | 1/1992 | WIPO . |
| WO 93/19400 | 9/1993 | WIPO . |

OTHER PUBLICATIONS

Borsenberger, Paul and David Weiss. Organic Photoreceptors for Imaging Systems. New York: Marcel–Dekker, Inc., 1993.

*Primary Examiner*—Christopher D. Rodee
*Attorney, Agent, or Firm*—Oblon, Spivak, McClelland, Maier & Neustadt, P.C.

[57] ABSTRACT

In the present invention, there is provide a toner for electrostatic image development comprising a resin, a coloring agent and a compound having at least one group represented by the formula:

—O—A—CO— [I]

wherein A represents a substituted or unsubstituted divalent hydrocarbon group.

6 Claims, No Drawings

TONER FOR ELECTROSTATIC IMAGE DEVELOPMENT BY HEAT

This application is a Division of application Ser. No. 08/679,337, filed on Jul. 11, 1996, now abandoned.

BACKGROUND OF THE INVENTION

The present invention relates to a dry toner for electrostatic image development in electrophotography, electrostatic printing, etc. More particularly it relates to a toner for electrostatic image development which is capable of providing a high printing density, causes little fouling (fogging) at a white area, and is low consumption, scarcely scattered in use and high in durability.

The developer used in electrocopiers and the like is once deposited, in the developing step, on a latent image carrier such as a photoreceptor having formed thereon a electrostatic image, then transferred therefrom onto a transfer paper in the transfer step, and fixed on a copying paper which serves as a substrate in the fixing step. As the developer used for electrostatic image development formed on a latent image carrier, there are known two-component developer comprising of a carrier and a toner, and one-component developer (magnetic toner and non-magnetic toner) in which no carrier is needed.

There are two types of toner to be contained in the developer: positively chargeable toner and negatively chargeable toner. The substances such as nigrosine dyes, quaternary ammonium salt-based compounds, etc., are known as the charge controlling agents capable of providing a positive charge to the toner, and the substances such as metal-containing dyes are known as the charge controlling agents capable of providing a negative charge to the toner. It is also known in a two-component developer that the charging characteristics of the toner can be controlled by coating the carrier.

Recently, a higher image quality and higher resolution efficiency are required in copiers and printers. In order to satisfy such requests, some attempts have been carried out for improving reproducibility of fine lines and gradation by reducing the toner particle size. However, the reduction of the toner particle size causes such problems as fouling of a white area wherein no image is formed, resulted from that the toner is deposited at said area, increase of consumption of the toner, increase of scattering of the toner particles and deterioration of durability.

As a result of the present inventors' earnest studies to solve these problems, it has been found that by incorporating a specific compound to a toner, the obtained toner is capable of providing high printing density, little fouling (fogging) at a white area, low consumption in use, low scattering in use and high durability. The present invention has been attained on the basis of this finding.

SUMMARY OF THE INVENTION

An object of the present invention is to provide a toner which is capable of providing high printing density, little fouling (fogging) at a white area, low consumption in use, low scattering in use and high durability.

To accomplish the aims, in an aspect of the present invention, there is provided a toner for electrostatic image development comprising a resin, a coloring agent and a compound having at least one group represented by the formula [I]:

$$—O—A—CO— \quad [I]$$

wherein A represents a substituted or unsubstituted divalent hydrocarbon group.

DETAILED DESCRIPTION OF THE INVENTION

A detailed explanation of the present invention is given below.

As the resin in the toner of the present invention, there can be used various known kinds of resin suited for the toner, which include styrene resins (homopolymers or copolymers containing styrene or styrene derivative) such as polystyrene, polychlorostyrene, poly-α-methylstyrene, styrene-chlorostyrene copolymer, styrene-propylene copolymer, styrene-butadiene copolymer, styrene-vinyl chloride copolymer, styrene-vinylacetate copolymer, styrene-acrylic ester copolymers (styrene-methylacrylate copolymer, styrene-ethylacrylate copolymer, styrene-butylacrylate copolymer, styrene-octylacrylate copolymer, styrene-phenylacrylate copolymer, etc.), styrene-methacrylic ester copolymers (styrene-methylmethacrylate copolymer, styrene-ethylmethacrylate copolymer, styrene-butylmethacrylate copolymer, styrene-phenylmethacrylate copolymer, etc.), styrene-α-methylchloroacrylate copolymer, and styrene-acrylonitrile-acrylic ester copolymers; vinyl chloride resins, rosin-modified maleic acid resins, phenol resins, epoxy resins, saturated or unsaturated polyester resins, polyethylene resins, polypropylene resins, ionomer resins, polyurethane resins, silicone resins, ketone resins, ethylene-ethylacrylate copolymer resins, xylene resins, polyvinylbutyral resins and polycarbonate resins. In these resins, styrene resins, saturated or unsaturated polyester resins and epoxy resins are especially preferred for use in the present invention. Also, these resins can be used either singly or in admixture of two or more of them.

It is also possible to use crosslinking binder resins such as disclosed in Japanese Patent Publication (KOKOKU) No. 51-23354 and Japanese Patent Application Laid-Open (KOKAI) No. 50-44836, and non-crosslinking binder resins such as disclosed in Japanese Patent Publication (KOKOKU) Nos. 55-6895 and 63-32180. It is preferable in terms of fixation and mechanical strength of the toner to prepare the resin used, whose molecular weight distribution is functionally divided into a low-molecular weight portion which plays the viscous component and a high-molecular weight portion which plays the elastic component after incorporated into a toner. In case where the difference in molecular weight between the low-molecular weight portion and the high-molecular weight portion is large, a medium-molecular weight substance having an intermediate molecular weight between those of said high-molecular weight and low-molecular weight portions may be added. In the resin of the present invention, molecular weight means weight-average molecular weight.

As the resin in the toner of the present invention, styrene resins are preferred. In this case, it is preferable that in the gel permeation chromatography (hereinafter abbreviated as GPC) measurement of the soluble part in tetrahydrofuran, there exists at least one peak corresponding to the low-molecular weight portion of the binder resin in the toner, with the position of the peak (Lp) being in the molecular weight range from 3,000 to 50,000, preferably from 4,000 to 30,000, and there also exists at least one peak or shoulder corresponding to the high-molecular weight portion, with the position of the peak or shoulder (Hp) being in the molecular weight range from 80,000 to 2,000,000, preferably from 100,000 to 1,500,000.

When the molecular weight at Lp of the low-molecular weight portion is less than 3,000, although good fixation is obtained, there tends to cause a spent phenomenon and finer crushing of the toner in the developing tank, resulting in formation of a defective image and shortening of the developer life. On the other hand, when the molecular weight at Lp of the low-molecular weight portion is more than 50,000, improper fixation in the low temperature range and cold offset tend to occur.

Also, when the molecular weight at Hp of the high-molecular weight portion is less than 80,000, although good fixation can be obtained, hot offset and narrowing of the usable temperature range tend to occur, and when the said molecular weight exceeds 2,000,000, improper fixation in the low temperature range and a rise of the least fixation temperature tend to take place.

The peak position of the molecular weight distribution can be measured by GPC under the following conditions.

GPC measurement is made by injecting 100 $\mu$l of a 0.1 wt % tetrahydrofuran sample solution while flowing the solvent (tetrahydrofuran) at a flow rate of 0.5 ml or 1 ml per minute at 40° C. In determining the molecular weight of the sample, the measuring conditions are selected so that the molecular weight distribution of the said sample is contained within the range where the calibration curve of the logarithm of the molecular weight v.s. the count number by using several types of monodisperse polystyrene standard samples gives a straight line. An example of column usable for the measurement: GPC column Plgel 10$\mu$ mixed type (7.5 mm in inner diameter and 30 cm in length, two columns joined) (mfd. by Polymer Laboratory Co.). The molecular weight of the binder resin in the toner can be determined in the same way.

The flow softening temperature (Tm) of the said resin is preferably in the range of about 80°–150° C. When the flow softening temperature is below 80° C., although the fixation temperature in hot roll fixing is low, hot offset tends to occur and also there may take place crushing of the toner in the developing tank and fusion of the toner on the carrier surface, or so-called spent phenomenon, which may cause nonuniformalization of the charged electricity distribution and deterioration of the quantity of charged electricity and may cause deterioration of durability of the developer. When the said flow softening temperature is more than 150° C., the fixing temperature tends to arise.

The said flow softening temperature (Tm) can be determined under the following conditions.

In a flow tester (CFT-500 mfd. by Shimazu Corporation), determination of Tm is carried out with 1 g of sample using a die with a 1 mm×10 mm nozzle under the conditions of 30 kg load, 5-minute preheating at 50° C. and heating rate of 3° C./min. The softening temperature is determined as the temperature at the halfway point of the flow distance between flow start and flow finish.

The glass transition temperature (Tg) of the said resin is preferably not lower than 50° C. If it is less than 50° C., agglomeration or cohesion of the toner particles tends to occur when they are left under a high temperature of more than 40° C. for a long time.

The glass transition temperature (Tg) can be determined in the following way.

In a differential thermal analyzer (DTA-40 mfd by Shimazu Corporation), a tangential line is drawn at the starting transition (variation) point of the curve determined under the condition of a heating rate of 10° C./min, and the temperature at the crossing point is regarded as the glass transition temperature.

As the coloring agent in the toner of the present invention, there can be used the known pigments and dyes, which include titanium oxide, zinc white, magnetite, carbon black, alumina white, calcium carbonate, Prussian blue, phthalocyanine blue, phthalocyanine green, Hansa yellow G, rhodamine dyes, chrome yellow, quinacridone, benzidine yellow, Rose Bengale, triallylmethane dyes, anthraquinone dyes, monoazo and diazo dyes, and the like. These coloring agents may be used either singly or as a mixture for the desired coloration of the toner.

As for the content of the coloring agent, it may be of any amount as far as the toner is colored thereby enough to form a visible image by development. Usually its content is preferably 1 to 20 parts by weight, more preferably 3 to 16 parts by weight, based on 100 parts by weight of the resin. If the content of the coloring agent is less than 1 part by weight, the printing density may be low, and if its content exceeds 20 parts by weight, the dispersion of coloring agent into the toner may be difficult to cause an increase of scattering toner.

The toner for electrostatic image development according to the present invention contains a compound having at least one group represented by the following formula [I] (this compound being hereinafter referred to as compound B):

$$—O—A—CO— \quad [I]$$

wherein A represents a substituted or unsubstituted divalent hydrocarbon group, the said group bonding directly between an oxygen atom and a carbonyl group.

Among the compounds B, those represented by the following formula [II] are particularly preferred:

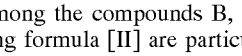

$$T—CO—[—O—A—CO—]_n—OH \quad [II]$$

wherein A is as defined in the above formula [I]; T represents a substituted or unsubstituted alkyl group, a substituted or unsubstituted alkenyl group, a substituted or unsubstituted cycloalkyl group, a substituted or unsubstituted polycycloalkyl group, a substituted or unsubstituted aryl group or a substituted or unsubstituted polyaryl group; and n is a natural number. Examples of these compounds include those disclosed in Japanese Patent Application Laid-Open (KOKAI) No. 63-23961.

The terminal group T is preferably of a structure which contains no ionic and strongly polar groups, more preferably has a molecular weight less than 300, and more preferably consists of carbon and hydrogen atoms or carbon, hydrogen and oxygen atoms. Exemplary of such groups are alkyl groups such as heptyl, octyl, undecyl, lauryl, heptadecyl and stearyl; alkenyl groups such as heptadecenyl and oleyl; cycloalkyl groups such as cyclohexyl and cycloheptyl; polycycloalkyl groups; aryl groups such as phenyl, xylyl and naphtyl; and polyaryl groups. In these groups, an alkyl group is preferable. These groups may be substituted with a hydroxyl, halogen or alkoxyl group (preferably having 1–4 carbon atoms), but the unsubstituted groups are preferred. Of the groups mentioned above, those having not more than 35 carbon atoms, more preferably 7 to 20 carbon atoms, are preferred. The natural number n is preferably 1 to 6.

Examples of the substituted or unsubstituted divalent hydrocarbon group A is preferably a substituted or unsubstituted divalent aliphatic group, more preferably a substituted or unsubstituted alkylene group (including a polymethylene group) and a substituted or unsubstituted alkenylene group. These groups are preferably the straight chain groups having couplers at both ends. It is also preferable that these groups are unsubstituted. These groups preferably have 8 to 20 carbon atoms. In case where the compound B has two or more A's in one molecule, they may be identical or different from each other. Two or more different compounds B may be used in admixture.

Preferred examples of the compounds represented by the formula [II] are as follows:

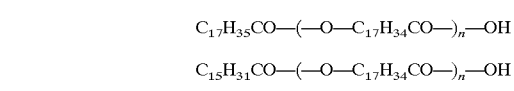

$$C_{17}H_{35}CO—(—O—C_{17}H_{34}CO—)_n—OH$$

$$C_{15}H_{31}CO—(—O—C_{17}H_{34}CO—)_n—OH$$

wherein n is as defined in the above formula [II].

The toner of the present invention becomes more effective when it contains the compound B of 0.0005 to 3 parts by weight, preferably 0.01 to 1 part by weight, based on 100 parts by weight of the resin. When the content is less than 0.0005 part, no satisfactory effect can be obtained, and when the content exceeds 3 parts, the toner fluidity may deteriorate and there tend to occur such faults as brush marks at a black area and chipping.

The toner of the present invention may further contain a known positive or negative charge controlling agent singly or in combination. Its content may be properly selected in view of the desired quantity of charged electricity, for example, it is preferably about 0.05 to 10 parts by weight based on 100 parts by weight of the resin. Examples of the positive charge controlling agents are nigrosine dyes, quaternary ammonium salt-based compounds, triphenylmethane-based compounds, imidazole-based compounds, and polyamine resins. Examples of the negative charge controlling agents include azo dyes containing metals such as Cr, Co, Al, Fe or the like, metal salicylate compounds, metal alkylsalicylate compounds, calixarene compounds and the like.

In the toner of the present invention, if necessary, there may be further contained other internal additives as adjuvants singly or in combination, which include, for example, known release agents such as low-molecular weight olefin polymers, lubricants such as metal soap, magnetic powders such as magnetite powder and ferrite powder, and organic or inorganic fillers.

It is also possible to add, as a constituent of the toner, internal or external additives including, for example, additives such as fine powder silica, alumina, titania or the like for adjustment of fluidity or charging characteristics of the toner, and an inorganic powder such as powder of magnetite, ferrite, cerium oxide, strontium titanate, conductive titania or the like and/or an organic powder such as power of styrene resin or acrylic resin for the purpose of adjustment of resistance or abresion. The contents of these additives may be properly decided according to the desired performance of the toner, for example, preferably fall in the range of about 0.01 to 10 parts by weight based on 100 parts by weight of the resin.

Various conventional methods can be applied for producing the toner particles of the present invention. According to a most common method, the raw materials such as resin, coloring agent, compound B, and if necessary, release agent and charge controlling agent are uniformly dispersed and mixed by a mixer, and the mixture is melted and kneaded by a suitable means such as enclosed kneader or single- or twin-screw extruder, then, after cooled, crushed by a crusher, hammer mill or like, further pulverized by a jet mill, high-speed rotor-driven mill or like, and then classified by a suitable means such as an air classifier (Elbow Jet adopting an inertial classification system, Microprex adopting a centrifugal classification system, DS Separator, etc.). The average particle size of the toner is preferably 3 to 20 $\mu$m, further the present invention is more effective when its average particle size is 3 to 8 $\mu$m. The average particle size of the toner can be determined as a volume-reduced value by using a Coulter counter (Model TA-II mfd. by Coulter Corp.).

Conventional mixers such as supermixer, Henschel mixer, V-type mixer, Y-type mixer, Nauta mixer, etc., can be used for mixing the raw materials before the melting and kneading thereof. A high-speed stirring mixer having a shearing action is preferably used. As for the mixing method, the raw materials such as resin, coloring agent, compound B, release agent and charge controlling agent may be blended and supplied into a mixer all at once, or part of the said raw materials and compound B may be preliminarily mixed by a mixer, followed by the feed of the remaining raw materials and further mixing. Also, part of the said raw materials and part of the compound B may be preliminarily mixed, followed by the feed of the remaining raw materials and the remainder of the compound B and further mixing.

The toner of the present invention can also be produced by preliminarily mixing a resin and part or whole of the compound B. This preliminary mixing may be performed in multiple stages, dividing the compound B in some portions and further, it is preferable to use whole compound B in the preliminarily mixing. It is also possible to add small quantities of other materials than the compound B in preliminary mixing provided that such addition of other raw materials won't adversely affect the intended effect of the present invention. Only part of the resin may be used in preliminary mixing, and further, it is preferable to add all of the resin in preliminary mixing. When the remaining raw materials are added and mixed after the preliminary mixing, such materials may be supplied all together or gradually in portions in which the times of mixing operation is plural.

Preliminary mixing can be conducted by stirring and mixing the materials by a known mixer such as mentioned above, and further, it is preferable to use a high-speed stirring mixer having the stirring blades rotating at high speed and giving a shearing action, such as supermixer or Henschel mixer. Use of such a mixer contributes to the improvement of the charging properties of the toner to allow formation of a high-quality image. For effecting sufficient mixing of the raw materials, the mixer operation is controlled so that the peripheral speed of the stirring blades is not less than 5 m/sec at the end thereof, with the mixing time being not less than 30 seconds, preferably not less than one minute in each operation. The total mixing time is preferably not less than one minute, more preferably not less than two minutes.

In case of subjecting the toner to external addition treatment, the classified toner and an external additive are mixed under stirring by, for example, a high-speed stirring mixer (Henschel mixer, supermixer, etc.). The toner of the present invention obtained in the manner described above may be used as a one-component developer (magnetic one-component toner containing a magnetic substance such as magnetite, or non-magnetic one-component toner containing non-magnetic substance) without carrier.

When the toner of the present invention is used as a two-component developer, a magnetic carrier is mixed with the said toner. Known magnetic carriers such as iron powder, ferrite powder, magnetic resin carrier, etc., can be used in the present invention. Magnetic carriers coated with a known silicone resin, acrylic resin, fluorine resin, styrene resin, epoxy resin, polyester resin, polyamide resin or a mixture thereof to form mono- or multi-layers, also can be used. As the ferrite core, a ferrite powder represented by the formula $(MO)_m(Fe_2O_3)_n$ is preferred. As the (MO) component, one or more of CuO, ZnO, NiO, FeO, MnO, MgO, BaO and the like may be exemplified.

The carrier particle size is not limited in the present invention, however preferably the average particle size of the carrier used is in the range of 10 to 200 $\mu$m. The carrier/toner mixing ratio is preferably 5–100/1 (parts by weight).

The toner according to the present invention is capable of providing a high printing density, causes little fouling (fogging) at a white area, is low in consumption, is scarcely scattered in use and is high in durability. The present invention is particularly implemental for production of toner with small particle sizes.

EXAMPLES

The present invention is described in more detail in the following examples, which examples however are presented for illustrative purposes only and should not be construed as limiting the invention in any away.

In the following Examples, all "parts" are by weight unless otherwise noted.

Example 1

To 100 parts of styrene/n-butyl acrylate copolymer resin (flow softening temperature: 145° C.; glass transition temperature: 64° C.), 0.45 part of a mixture (mixture B) of $C_{17}H_{35}CO—(—O—C_{17}H_{34}CO—)_n—OH$ (n=0–4) and $C_{15}H_{31}CO—(—OC_{17}H_{34}CO—)_n—OH$ (n=0–4) was added and mixed by a supermixer (mfd. by Kawata MFG. Co., Ltd.), followed by addition of 14 parts of a coloring agent (carbon black, MA-100S, produced by Mitsubishi Chemical Corporation), one part of a charge controlling agent (BONTRON S-34, produced by Orient Chemical Industries Ltd.) and 2.5 parts of polypropylene (HIGH WAX NP-505, produced by Mitsui Petrochemical Industries Ltd.) and further mixing. The mixture was kneaded by a continuous twin-screw extruder, then cooled, crushed and classified to obtain a black toner having a volume-average particle size of 5 $\mu$m. To 100 parts of the obtained toner material, one part of silica powder (R972, produced by Nippon Aerosil K. K.) and one part of magnetite powder (KBC-100, produced by Kanto Denka Kogyo Co., Ltd.) were added and mixed by a supermixer to obtain a toner A. Four parts of this toner A was mixed under stirring with 96 parts of a ferrite carrier coated with an acryl-modified silicone resin and having an average particle size of 100 $\mu$m to obtain a developer A. Using this developer A as starting developer and the toner A as supplementary toner, printing was carried out with an electrophotographic laser printer (JX-9700 mfd. by SHARP Corporation). The density at the printed black area (which is called "printing density") measured by a Macbeth illuminator was not less than 1.35 (excellent), and the difference of Hunter whiteness of the paper after printing from that before printing (which is called "fogging" factor) as measured by a differential colorimeter (mfd. by Nippon Denshoku Kogyo Co., Ltd.) was as small as 0.15 (excellent). A high-quality image could be obtained up to 9,000 copies. Toner consumption was low and little scatter of toner took place.

Comparative Example 1

The same procedure as in Example 1 was conducted except that the mixture B was not incorporated to produce a toner B and a developer B. The printing density and fogging factor were evaluated in the same way as in Example 1. Though the printing density of the product was at the same level as that of Example 1, the fogging factor of the product was 0.59 and worse than that of Example 1.

Example 2

The same procedure as in Example 1 was conducted except that the carbon black was changed to #25B (produced by Mitsubishi Chemical Corporation) to produce a toner C and a developer C. The printing density and fogging factor were evaluated in the same way as in Example 1. The printing density was above 1.35 while the fogging factor was 0.20, both being quite satisfactory. A high-quality image could be obtained up to 9,000 copies. Toner consumption was low and scatter of toner was little.

Comparative Example 2

The same procedure as in Example 2 was conducted except that the mixture B was not incorporated to produce a toner D and a developer D. The printing density and fogging factor were evaluated in the same way as in Example 1. Though the printing density of the product was substantially equal to Example 2, the fogging factor of the product was 0.52 and worse than that of Example 2.

As is seen from the above Examples and Comparative Examples, the toner containing the compound B specific to the present invention is very excellent in performance as compared with the toner containing no such compound B.

What is claimed is:

1. A method of fixing a dry toner for electrostatic image development by heat, comprising hot roll fixing the dry toner upon a copying paper wherein the dry toner comprises a resin, a coloring agent and a compound represented by the formula II:

$$T—CO—(—O—A—CO—)n—OH \qquad \text{II}$$

wherein A represents a substituted or unsubstituted divalent hydrocarbon group; T represents an substituted or unsubstituted alkyl group, a substituted or unsubstituted alkenyl group, a unsubstituted cycloalkyl group, a substituted or unsubstituted polycycloalkyl group, a substituted or unsubstituted aryl group, or a substituted or unsubstituted polyaryl group; and n is a natural number.

2. A method according to claim 1, wherein the compound represented by the formula II is a compound represented by the following formula III:

$$C_{17}H_{35}CO—(—O—C_{17}H_{34}—CO—)_n—OH \qquad \text{III}$$

wherein n is a natural number.

3. A method according to claim 1, wherein the compound represented by the formula II is a compound represented by the following formula IV:

$$C_{15}H_{31}CO—(—O—C_{17}H_{34}—CO—)_n—OH \qquad \text{IV}$$

wherein n is a natural number.

4. A method according to claim 1, wherein the content of the compound represented by the formula II is 0.0005 to 3 parts by weight based on 100 parts by weight of the resin.

5. The method according to claim 1 wherein the resin is a styrene-butyl acrylate copolymer.

6. The method according to claim 1, wherein the resin is a styrene resin.

* * * * *